United States Patent [19]

Zalman

[11] Patent Number: 4,685,161

[45] Date of Patent: Aug. 11, 1987

[54] FOLDABLE FRAMEWORK AND PORTABLE OBJECTS HAVING SUCH A FRAMEWORK

[76] Inventor: Zaharia Zalman, 50 Hankin Street, Holon 58 330, Israel

[21] Appl. No.: 840,507

[22] Filed: Mar. 17, 1986

[30] Foreign Application Priority Data

Apr. 3, 1985 [IL] Israel ..... 74891

[51] Int. Cl.[4] ..... A61G 1/00; A47C 19/16

[52] U.S. Cl. ..... 5/82 R; 5/111; 5/116; 5/117; 403/55; 403/93

[58] Field of Search ..... 5/82 R, 110–112, 5/116, 117; 403/55, 92, 93, 100, 102

[56] References Cited

U.S. PATENT DOCUMENTS

| | | | |
|---|---|---|---|
| 926,438 | 6/1909 | Ranko | 5/111 |
| 1,129,089 | 2/1915 | Hajas | 5/117 |
| 2,650,373 | 9/1953 | Zeller et al. | 5/111 |
| 3,555,578 | 1/1971 | Pile | 5/111 |
| 3,886,606 | 6/1975 | Bradford | 5/82 |

*Primary Examiner*—Gary L. Smith
*Assistant Examiner*—Michael F. Trettel
*Attorney, Agent, or Firm*—Steinberg & Raskin

[57] ABSTRACT

A foldable framework and foldable objects such as stretchers, foldable beds, foldable bridges and the like embodying such framework. The framework comprises first and second carrier rod assemblies linked to each other by foldable connecting means, each such assembly comprising four rods linked by three joints, a central joint and two peripheral joints so designed that the extreme rods of the two carrier rod assemblies swing in different planes. In consequence, in the folded state the extreme rods of one carrier rod assembly come to rest between the extreme rods of the other carrier rod assembly.

6 Claims, 9 Drawing Figures

FOLDABLE FRAMEWORK AND PORTABLE OBJECTS HAVING SUCH A FRAMEWORK

The present invention concerns foldable and portable objects such as a portable bridge, a portable bed or a portable stretcher. The portable objects with which this invention is concerned are of a kind that have foldable connecting elements such as foldable braces and straps, extending between two parallel assemblies of carrier rods and imposing some limitations on the manner in which such an object can be folded.

In the following specification the invention will be described particularly with reference to a foldable stretcher it being understood that it is not confined thereto.

Typically, a foldable stretcher is required by persons moving on foot in locations where there is no access to normal ambulance services, e.g. expeditions for the exploration of remote areas, for example mountain climbing expeditions; hikers; infantry in combat; and the like. In all such situations there is usually an aid-man who has to carry a foldable stretcher on his back in addition to his personal equipment.

It is easily understood that in situations of this kind it is of paramount importance that the foldable stretcher, in addition to having to be of as light a material as possible should also be foldable into as small as possible a size so as not to interfere with the bearer's freedom of movement. However, the canvas and foldable bracing and supporting means impose limitations and restrictions on the ability to fold a stretcher and in consequence known foldable stretchers are as a rule only foldable twice, once by collapsing the braces and connecting elements so as to bring the two carrier rod assemblies into close proximity to each other and a second time by folding the said rod assemblies over, thereby to reduce their size into half. Assuming that a stretcher measures as a rule 2.10 meters, a so folded stretcher measures about 1.05 meters and it is easily understood that with this size the folded stretcher hampers the movements of the bearer. It is therefore the object of the present invention to provide a foldable stretcher which can be folded into a compact state of reduced size.

Quite generally, it is the object of the present invention to provide portable foldable objects that can be folded into a compact folded state to facilitate carrying and transportation.

With these objects in view, the invention provides a foldable framework comprising first and second carrier rod assemblies linked to each other by foldable connecting means, each of said first and second carrier rod assemblies comprising a central joint, a pair of inner rods each pivoted to one edge of the central joint such that said inner rods can be folded towards each other around a folding axis that extends in space in a direction normal to the longitudinal axis of the central joint, a pair of extreme rods each linked to the associated inner rod by a joint (peripheral joint) so as to be foldable about a folding axis extending in space in a direction that forms an angle with the folding axis of the central joint; the folding axis of the peripheral joint of the first carrier rod assembly extending in space essentially normal to the folding axis of the central joint and the folding axis of the second carrier rod assembly extending in space in a direction that forms with the folding axis of the central joint an angle other than 90°, such that in the folded state the extreme rods of the second carrier rod assembly come to rest between the extreme rods of the first carrier rod assembly.

The invention further provides a portable foldable object having a foldable framework as specified.

One typical application of the invention consists in a portable stretcher comprising a foldable framework as specified and a canvas held by said first and second carrier rod assemblies.

By another application the invention provides a portable bed having a foldable framework as specified, and by yet another application the invention provides a portable bridge comprising a foldable framework as-specified.

These are, of course, examples only and many other applications are conceivable.

Preferably, the frameworks according to the invention are made of light metals such as, for example, aluminium.

The invention is illustrated, by way of example only, in the accompanying drawings in which.

Figure 1:
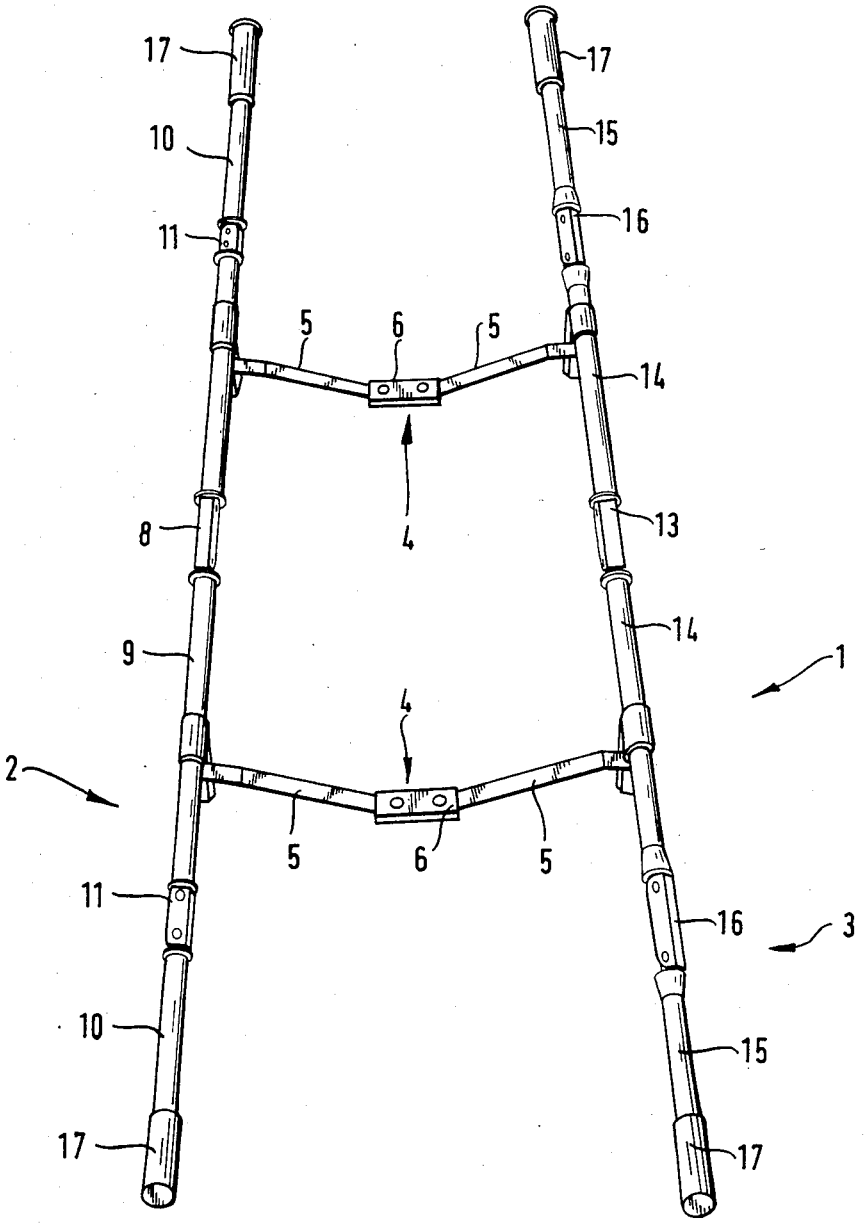
FIG. 1 is a perspective view from above of a stretcher framework according to the invention in the unfolded state.

The stretcher framework 1 here shown comprises a first carrier rod assembly 2 and a second carrier rod assembly 3 interconnected by a pair of foldable arched braces 4, each comprising a pair of bars 5 and a link 6, each of bars 5 being pivoted at one end to a link 6 and at the other end to the associated carrier rod assembly. At its rear side the framework 1 comprises four legs 7, two integral with rod assembly 2 and two with rod assembly 3.

Figure 3:
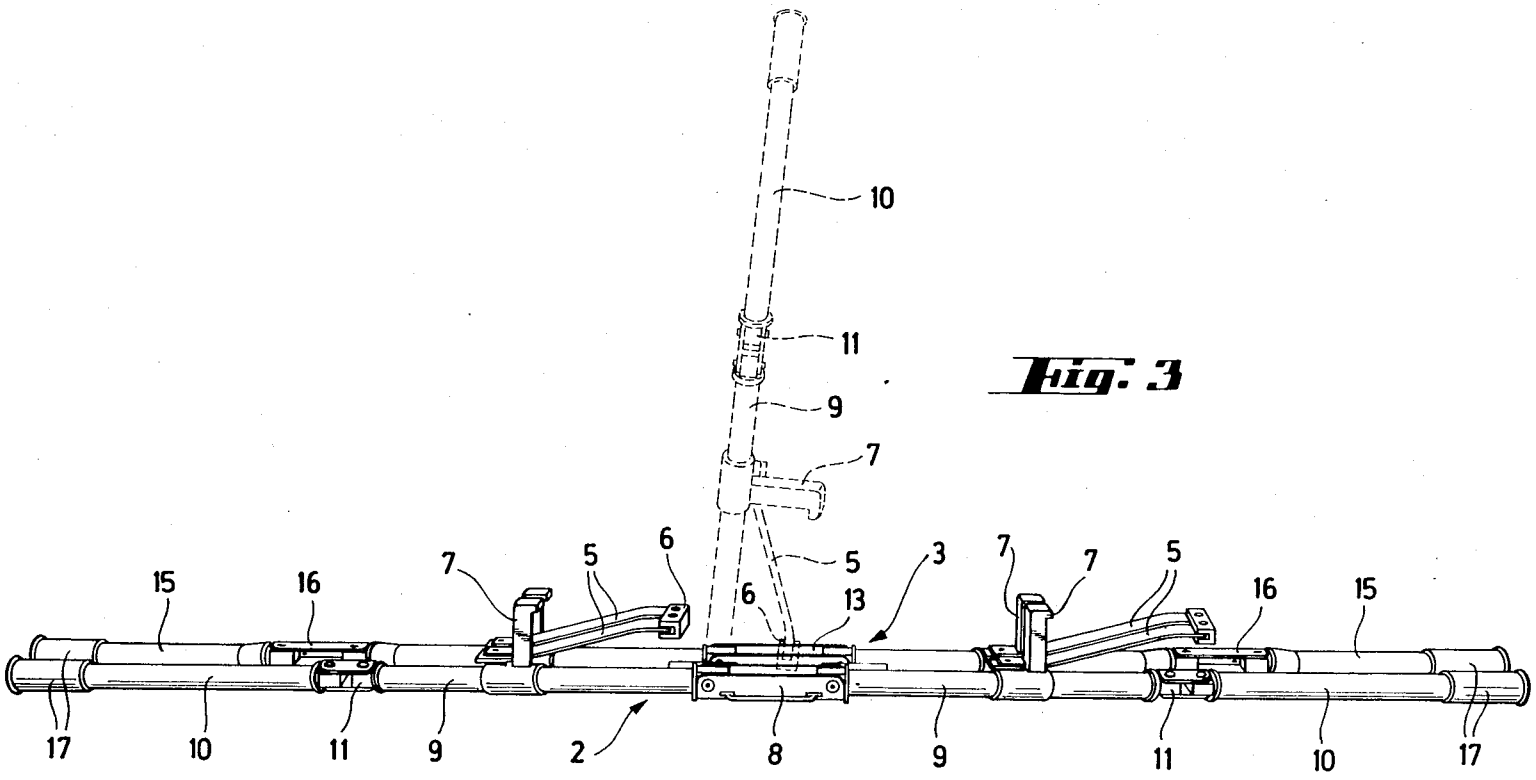
FIG. 3 is a perspective side view of the framework of FIG. 1 drawn to a larger scale and showing it in the initial stage of folding.
Figure 4:
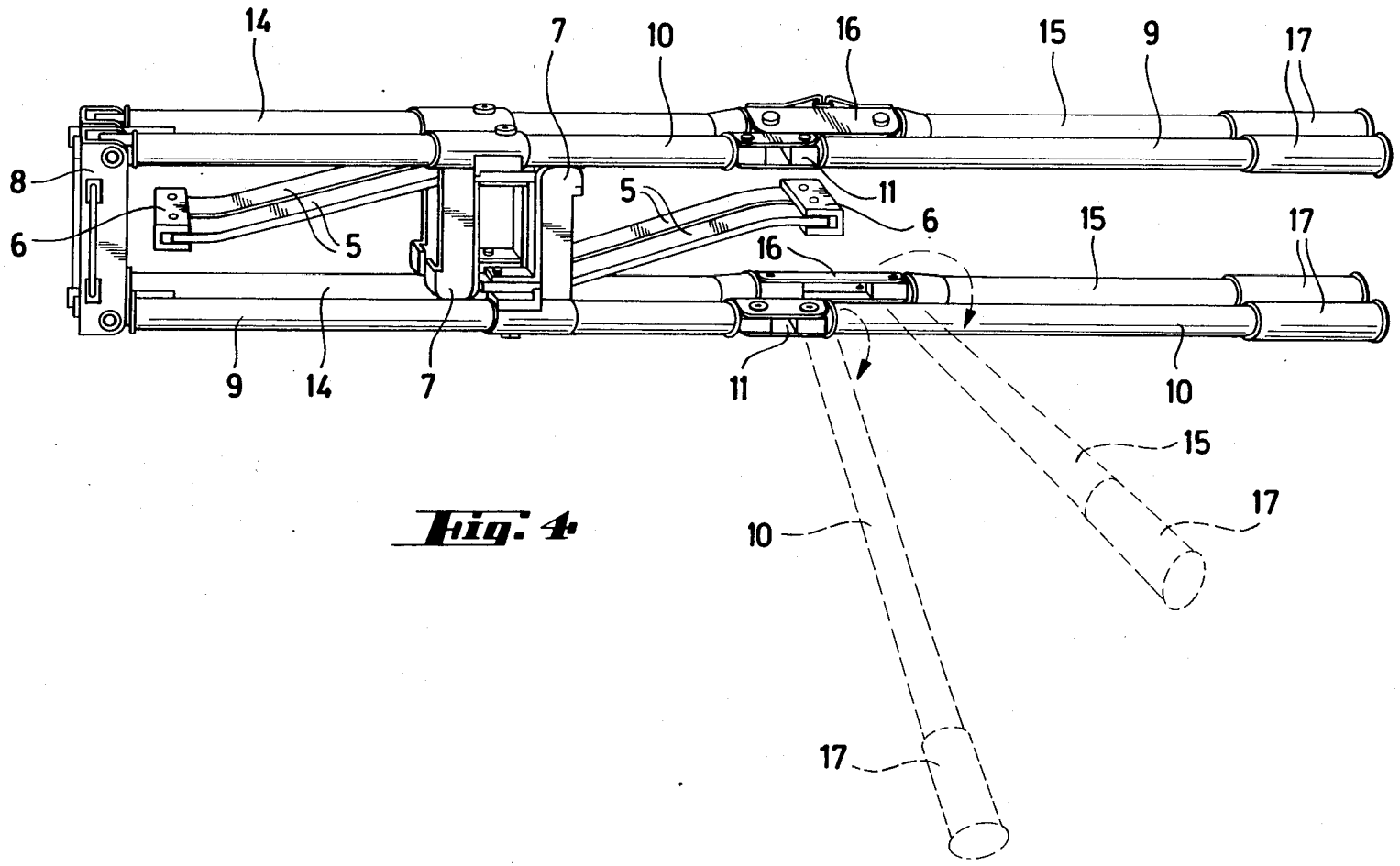
FIGS. 4, 5 and 6 are perspective views showing the framework in various stages of folding.
Figure 5:
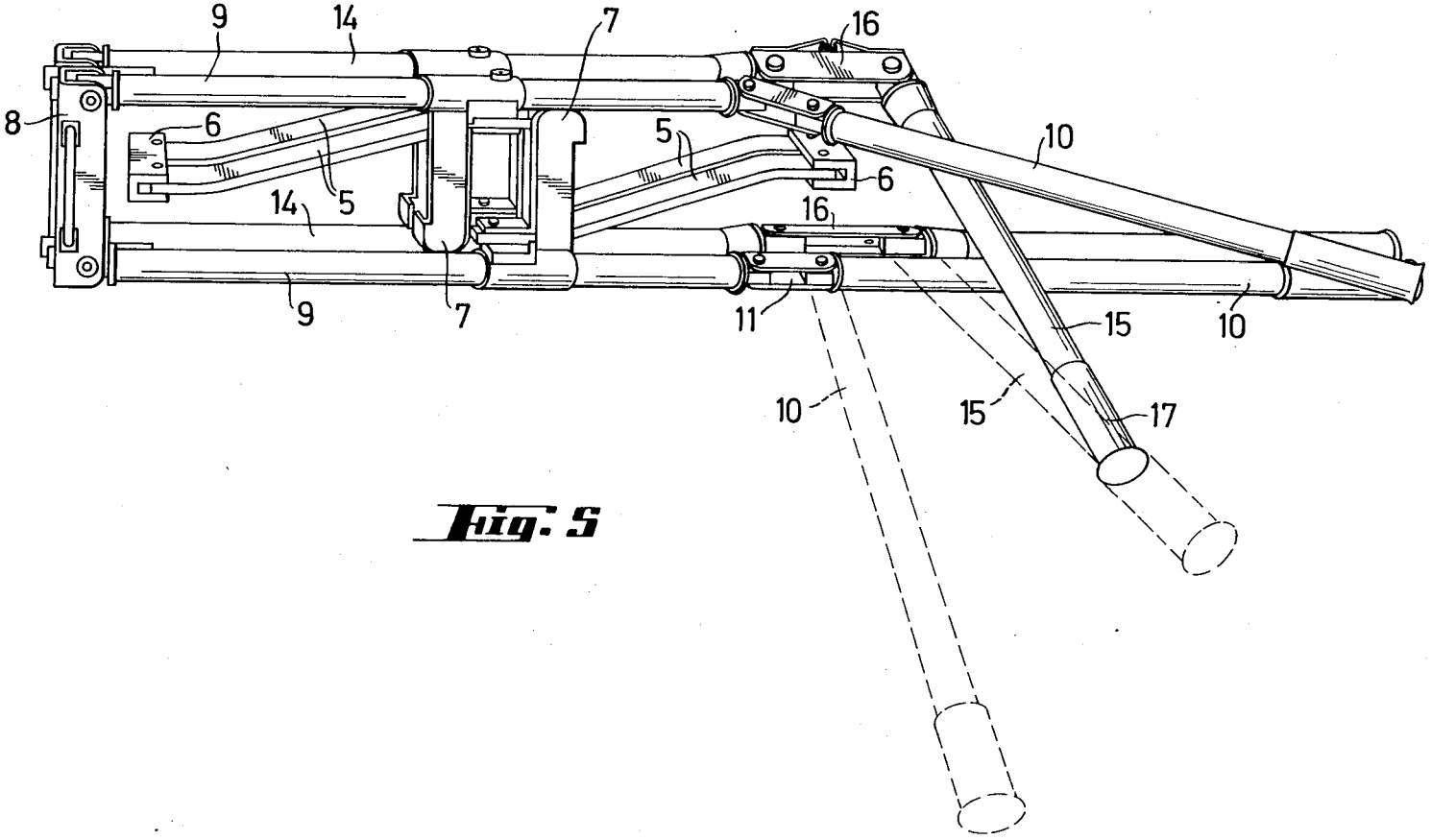
Figure 6:
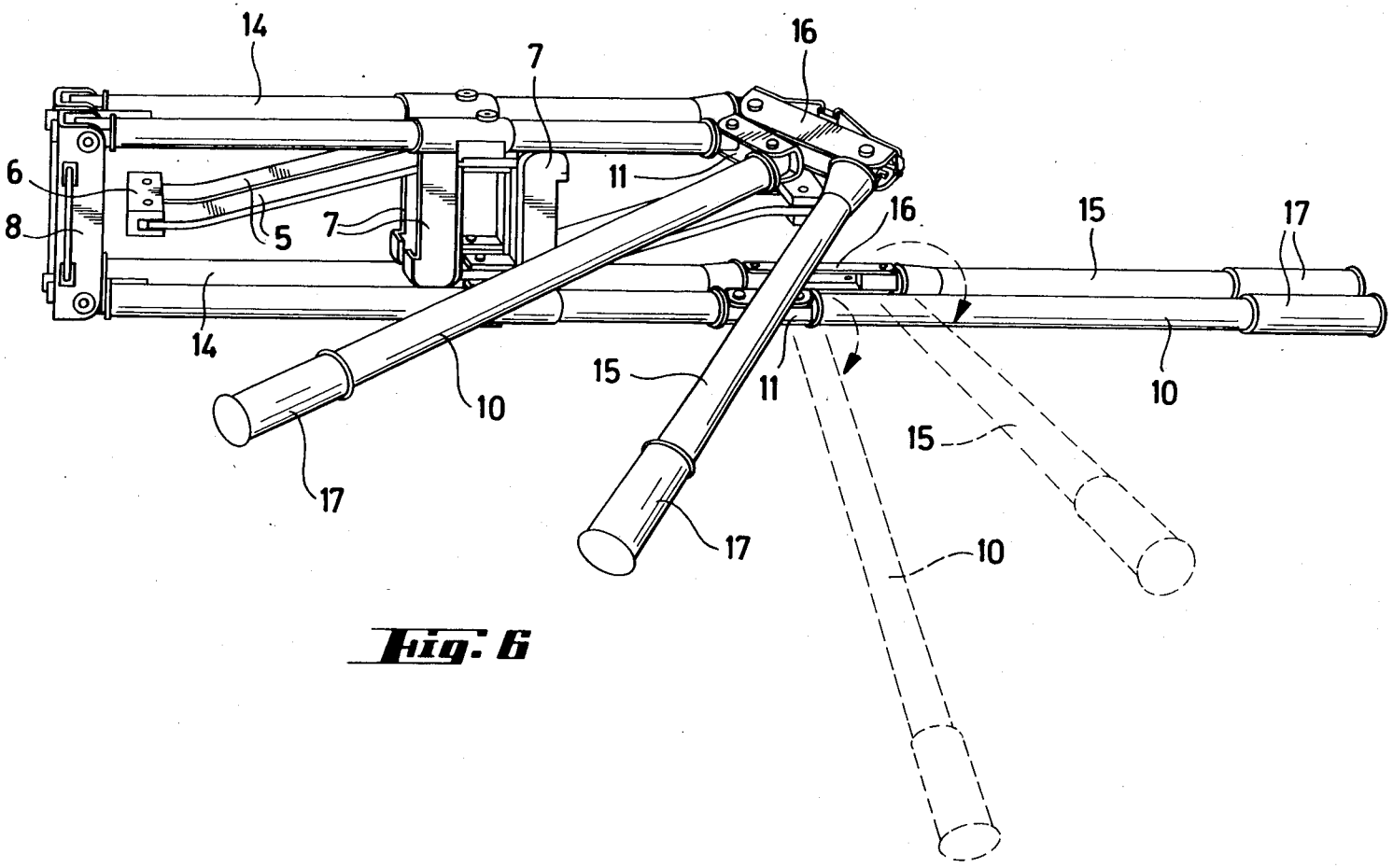
Figure 7:
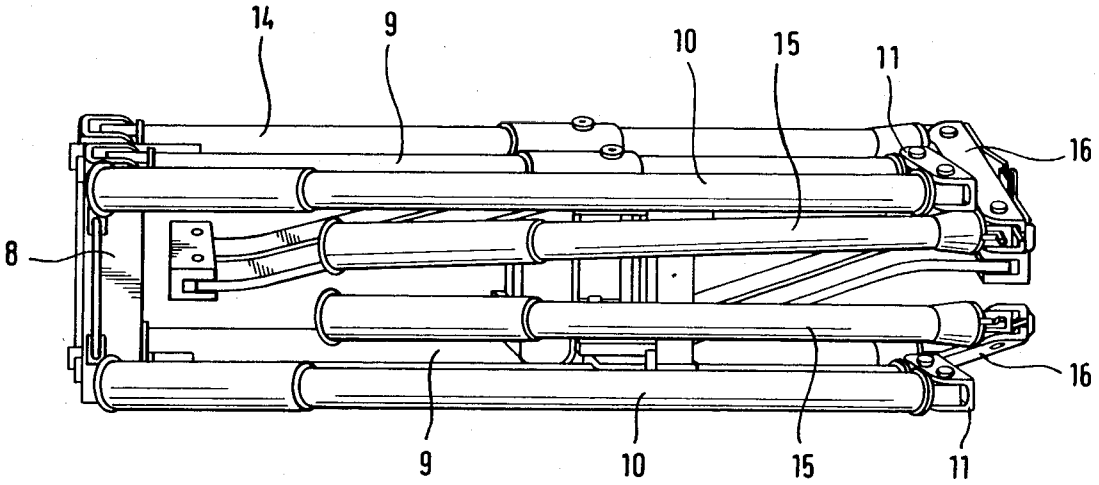
FIG. 7 is a perspective view showing the stretcher in the fully folded state.

The first rod assembly 2 comprises a central joint 8 to which there are pivotally connected two inner rods 9 in such a way that each rod 9 is swingable by 90° around an axis which extend in space in a direction normal to the longitudinal axis of joint 8, into positions shown in FIGS. 3 and 4. The first rod assembly further comprises a pair of extreme rods 10 each linked to the associate rod 9 by means of a peripheral joint 11, the connection between joint 11 and each of rods 9 and 10 being pivotal in such a way that the assembly 10, 11 is foldable about a folding axis that extends in space in a direction normal to that of the folding axis of the central joint 8 in the manner shown in FIGS. 4 to 6 to reach the couble folded position shown in FIG. 7. In the fully unfolded operative state of the stretcher peripheral joints joints 11 are prevented from folding by the canvas and the weight of the patient it carries.

The second carrier rod assembly 3 comprises a central joint 13, a pair of inner rods 14 pivotally connected to the central joint 13 in a similar manner as rods 9 to the central joint 8, and a pair of extreme rods, 15, each of which is pivotally linked to the associated rod 14 via a peripheral joint 16 in such a way that the assembly 16, 16 is foldable about a folding axis that extends in space in a direction that forms with the folding axis of joint 13 an angle other than 90°. In consequence, each extreme rod 15 is swingable in a plane which interacts the plane of the unfolded framework. Because of this and in order to prevent an unintentional collapse, joints 16 have a locking mechanism, as will be described in detail further below.

At their ends the extreme rods 10 and 15 are fitted with handles 17.

The folding of the framework 1 will now be described.

Figure 2:
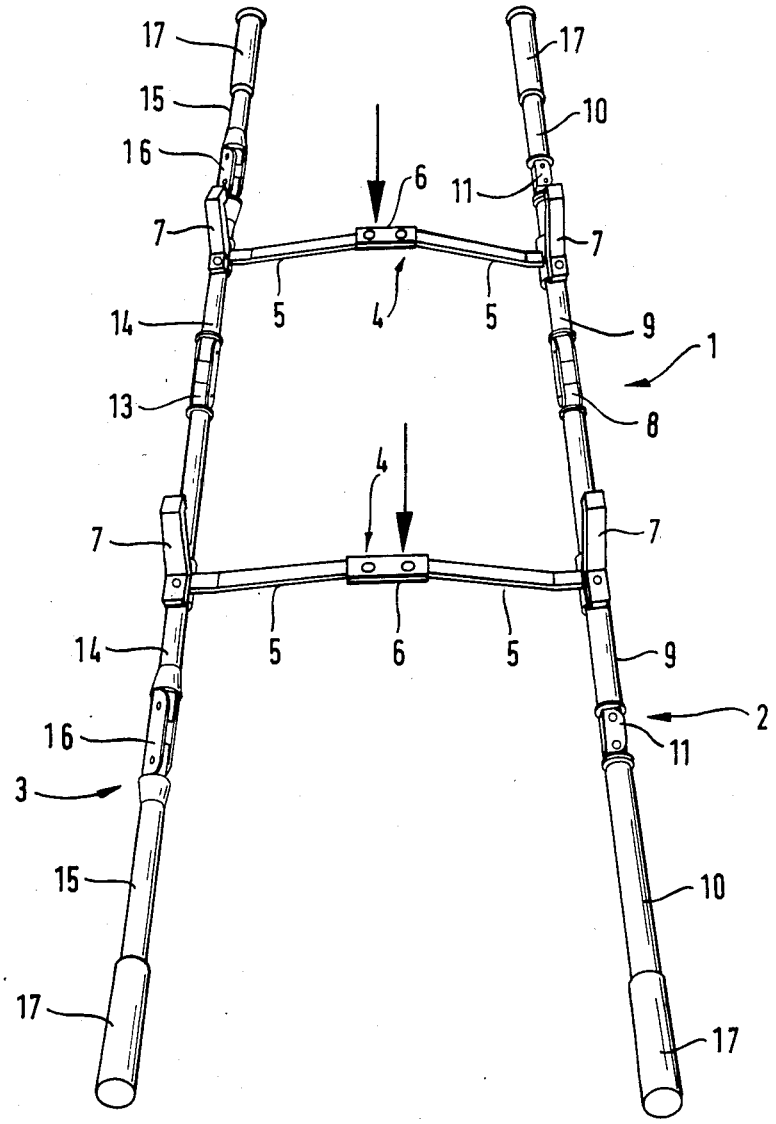
FIG. 2 is a perspective view from the rear side of the stretcher framework according to FIG. 1.

Starting from the unfolded state of FIGS. 1 and 2, the foldable braces 4 are collapsed by pressing links 6 whereby each bar 5 is caused to swing as indicated by the arrows in FIG. 2 and the frame reaches the state shown in FIG. 3 in which the two carrier rod assemblies 2 and 3 come to rest in close proximity to each other. From this state each of the assemblies 9, 10, 11 and 14, 15, 16 is swung by 90° around the pivots by which the inner rods 9 and 14 are linked to the central joint 8. The beginningof this folding phase is shown in broken lines in FIG. 3 and the end thereof is shown fully drawn out in FIG. 4. As shown in FIG. 4, at the end of this phase the frame has assumed a U-shaped structure with the members 5, 6 of braces 4 and legs 7 positioned within the U in the manner shown.

It should be noted that in practice the framework 1 is associated with a canvas which in the unfolded state of FIG. 1 is located above the arched braces 4, and this dictates that the extreme rods 10 and 15 must all be folded onto the same face of the canvas. The canvas is not shown in the drawings for the sake of clarity of illustration.

As can be readily seen from FIGS. 3 and 4, the spatial orientations of the pivots and thereby of the folding axis of the central joints 8 and 13 on the one hand and of the peripheral joint 11 on the other hand, are normal to each other while the spatial orientation of the pivots and thereby of the folding axis of the peripheral joint 16 forms with that of the central joints 8 and 13 an angle other than 90°. In consequence, when the extreme rods 10 and 15 are double folded about the folding axes of the associated joints 11 and 16, respectively, they move in different planes. The progress of this phase of the folding is shown in FIGS. 4, 5 and 6 and FIG. 7 shows the fully folded stretcher. In FIG. 4 the once-folded state of the extreme rods 10 and 15 is shown in broken line while in FIGS. 5 and 6 two of the folding extreme rods 10 and 15 are shown in drawn out lines and the other two are shown in broken lines. By following these figures, it is easily seen how the extreme rods 10 and 15 swing in different planes and by then referring to FIG. 7, it is seen how in consequence thereof in the totally folded state of the stretcher the two extreme rods 15 of the second carrier rod assembly come to rest between the extreme rods 10 of the first assembly.

Figure 8:
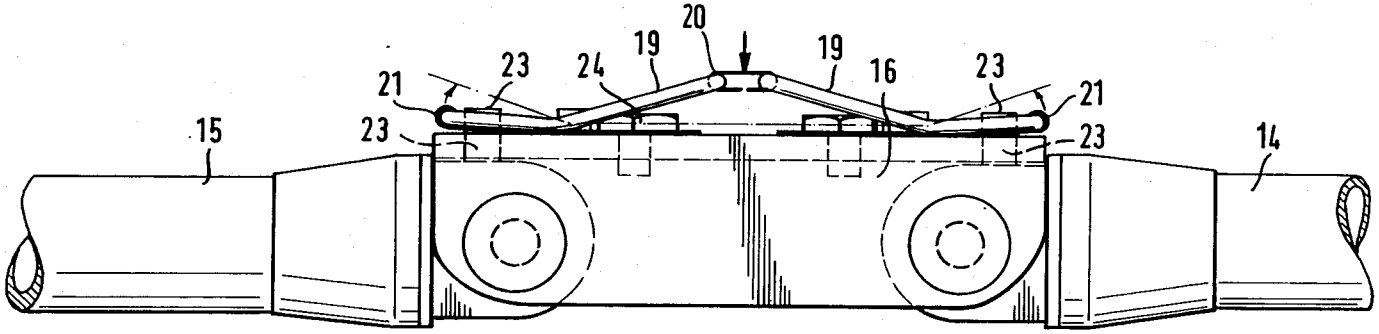
FIGS. 8 and 9 are respectively elevation and plan view of one of the peripheral joints of the framework, drawn to a larger scale and showing a locking mechanism thereof.
Figure 9:
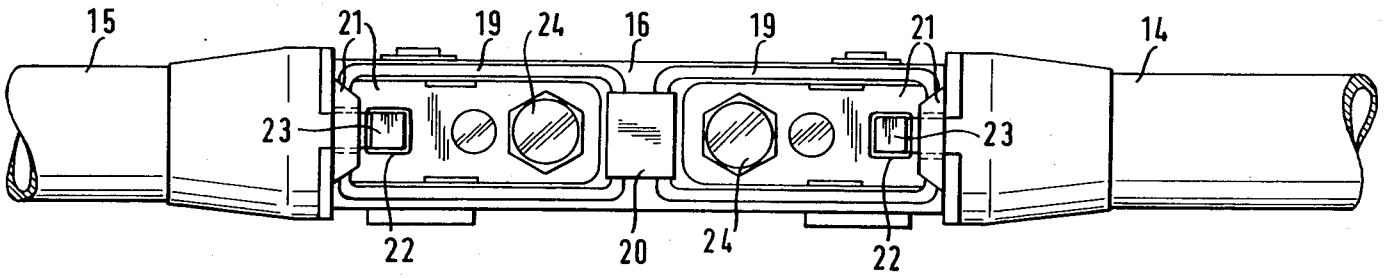

In FIGS. 8 and 9 a joint 16 is shown drawn to a larger scale and having locking means to prevent undesired folding of bars 15 and 14 of the second carrier rod assembly 3.

As shown the joint 16 comprises a bulging, resilient locking device having two annular members 19 held together by a link 20. Mounted on the top face of the joint 16 are two plates 21 each having a re-entrant edge retaining the end portions of the associated annular member 19. Near one of its ends each plate 21 is connected to the joint by means of a rivet 24.

Each of plates 21 comprises a hole 22 which cooperates with a boss 23 integral with the associated rod 14 or 15.

When the locking device is in the locking position shown in FIGS. 8 and 9 in drawn out lines, bosses 23 are locked by holes 22 and in consequence it is not possible to swing the rods 14 and 15 around their pivots and this prevents undesired folding over of the rods. When it is desired to fold the stretcher, joints 16 are unlocked by depressing link 20 whereby the terminal portions of the annular members 19 and plates 21 are raised into the position shown in broken lines in FIG. 8. In that position bosses 23 are released and this enables the free swinging of rods 14 and 15 into the folded state. When the stretcher is unfolded the locking devices of joints 16 snap back into the locking state shown in FIGS. 8 and 9.

While the invention has hereinbefore been described with reference to stretchers, it will readily be understood by people versed in the art that by following the same teachings it is possible to make other portable and foldable objects such as foldable beds, foldable bridges and the like.

I claim:

1. A foldable framework comprising first and second carrier rod assemblies linked to each other by foldable connecting means, each of said first and second carrier rod assemblies comprising a central joint, a pair of inner rods each pivoted to one edge of the central joint such that said inner rods can be folded towards each other around a folding axis that extends in space in a direction normal to the longitudinal axis of the central joint, a pair of extreme rods each linked to the associated inner rod by a peripheral joint so as to be foldable about a folding axis extending in space in a direction that forms an angle with the folding axis of the central joint; the folding axis of the peripheral joint of the first carrier rod assembly extending in space essentially normal to the folding axis of the central joint and the folding axis of the second carrier rod assembly extending in space in a direction that forms with the folding axis of the central joint an angle other than 90° such that in the folded state the extreme rods of the second carrier rod assembly come to rest between the extreme rods of the first carrier rod assembly.

2. A stretcher having a foldable framework according to claim 1.

3. A foldable bed having a foldable framework according to claim 1.

4. A foldable bridge having a foldable framework according to claim 1.

5. A foldable framework comprising first and second carrier rod assemblies linked to each other by foldable connecting means, each of said first and second carrier rod assemblies comprising a central joint, a pair of inner rods each pivoted to one edge of the central joint such that said inner rods can be folded towards each other around a folding axis that extends in space in a direction normal to the longitudinal axis of the central joint, a pair of extreme rods each linked to the associated inner rod by a peripheral joint, each of which peripheral joints is adapted for folding about a folding axis extending in space in a direction that forms an angle with the folding axis of the central joint; the folding axis of the peripheral joint of the first carrier rod assembly extending in space essentially normal to the folding axis of the central joint thereof and the folding axis of the central joint of the second carrier rod assembly extending in space in a direction that forms with the folding axis of the central joint thereof an angle other than 90° whereby in the folded state the extreme rods of the second carrier rod assembly come to rest between the extreme rods of the first carrier rod assembly.

6. A foldable framework according to claim 5, characterized by manually releasable locking means being provided on at least each of the peripheral joints of one of the carrier rod assemblies and adapted to lock the peripheral locks in the unfolded state.

* * * * *